US012745803B2

(12) United States Patent
Fuemmeler et al.

(10) Patent No.: US 12,745,803 B2
(45) Date of Patent: Sep. 29, 2026

(54) ELECTRONIC NICOTINE DELIVERY DEVICE ASSESSMENT SYSTEM AND METHOD OF USE THEREOF

(71) Applicants: VIRGINIA COMMONWEALTH UNIVERSITY, Richmond, VA (US); PENNINGTON BIOMEDICAL RESEARCH INSTITUTE, Baton Rouge, LA (US); EAST CAROLINA UNIVERSITY, Greenville, NC (US)

(72) Inventors: Bernard Fuemmeler, Henrico, VA (US); Thomas Eissenberg, Henrico, VA (US); Corby Martin, Baton Rouge, LA (US); Eric Soule, Greenville, NC (US)

(73) Assignees: Virginia Commonwealth University, Richmond, VA (US); PENNINGTON BIOMEDICAL RESEARCH INSTITUTE, Baton Rouge, LA (US); East Carolina University, Greenville, NC (US)

( * ) Notice: Subject to any disclaimer, the term of this patent is extended or adjusted under 35 U.S.C. 154(b) by 487 days.

(21) Appl. No.: 18/005,624

(22) PCT Filed: Jul. 27, 2021

(86) PCT No.: PCT/US2021/043348
§ 371 (c)(1),
(2) Date: Jan. 16, 2023

(87) PCT Pub. No.: WO2022/026487
PCT Pub. Date: Feb. 3, 2022

(65) Prior Publication Data

US 2023/0263232 A1 Aug. 24, 2023

Related U.S. Application Data

(60) Provisional application No. 63/058,168, filed on Jul. 29, 2020.

(51) Int. Cl.
*A24F 40/50* (2020.01)
*A24F 40/60* (2020.01)
*A24F 40/65* (2020.01)

(52) U.S. Cl.
CPC ..... *A24F 40/50* (2020.01); *A24F 40/60* (2020.01); *A24F 40/65* (2020.01)

(58) Field of Classification Search
CPC ..... A24F 40/50; A24F 40/60; A24F 40/65
See application file for complete search history.

(56) References Cited

U.S. PATENT DOCUMENTS 10,653,187 B1 5/2020 Doyle et al.
11,633,554 B1 * 4/2023 Puviani ..... A61K 31/4045 128/200.14

(Continued)

*Primary Examiner* — Paul B Yanchus, III
*Assistant Examiner* — Michael V Farina
(74) *Attorney, Agent, or Firm* — WCF IP

(57) ABSTRACT

Provided are systems and methods of identifying the functional characteristics and operational settings of any electronic inhalants or apparatuses that are designed to provide nicotine vapors to a user. The system includes a mobile device having a built-in camera to receive images of a nicotine delivery device, a system of remote backend servers with at least one image database for identifying the nicotine delivery device, and at least one processor for calculating an amount of nicotine delivered by the nicotine delivery device.

18 Claims, 9 Drawing Sheets

(56) References Cited

U.S. PATENT DOCUMENTS

| | | | | |
|---|---|---|---|---|
| 2014/0193157 | A1* | 7/2014 | Du | G08C 17/02 398/106 |
| 2017/0046357 | A1* | 2/2017 | Cameron | A24F 40/30 |
| 2017/0266397 | A1* | 9/2017 | Mayle | A61M 15/06 |
| 2019/0053545 | A1 | 2/2019 | Cameron et al. | |
| 2019/0151599 | A1* | 5/2019 | Hanrahan | A61M 16/0003 |
| 2019/0158938 | A1* | 5/2019 | Bowen | A24F 40/65 |
| 2019/0307170 | A1* | 10/2019 | Zarifian | G05D 11/13 |
| 2019/0387796 | A1 | 12/2019 | Cohen | |
| 2020/0000143 | A1* | 1/2020 | Anderson | G06F 3/16 |
| 2021/0089946 | A1* | 3/2021 | Pegors | G06N 5/04 |
| 2021/0110159 | A1* | 4/2021 | Shashua | G16H 20/60 |
| 2023/0226281 | A1* | 7/2023 | Helmer | A61M 5/002 604/500 |
| 2023/0354911 | A1* | 11/2023 | Bonastre Leiva | A24F 40/10 |

* cited by examiner

ELECTRONIC NICOTINE DELIVERY DEVICE ASSESSMENT SYSTEM AND METHOD OF USE THEREOF

CROSS REFERENCE TO RELATED APPLICATIONS

This application claims priority to and benefit of U.S. Provisional Patent Application No. 63/058,168, filed on Jul. 29, 2020, which is hereby incorporated by reference herein in its entirety.

STATEMENT OF GOVERNMENT INTEREST

This invention was made with government support under Grant No. R21 CA239188 awarded by the National Institutes of Health. The government has certain rights in the invention.

FIELD OF THE INVENTION

The present disclosure generally relates to a system and a method of assessing electronic inhalants or apparatuses. In particular, the invention provides an assessment system and a method of using such system to estimate, identify, determine, predict and/or assess the functional characteristics and operational settings of any electronic vaporizers that are designed to provide vapors to a user. The system and method of the present disclosure particularly provide commercial electronic nicotine delivery system (ENDS) identification and characteristic assessment, e.g., power, energy, temperature, etc., which may be used as a guideline for adjusting nicotine doses for the individual users in both clinical and non-clinical settings.

BACKGROUND

Electronic Nicotine Delivery Systems (ENDS) device is an umbrella term that encompasses vape pens, pods, tanks, mods and electronic cigarettes, in which most of these are designed to simulate cigarette or cigar smoking using aerosolized vapor instead of smoke. The global market for ENDS has grown precipitously in the past decade. According to the comprehensive survey published in *Tob Control* 2014, there are more than 460 different brands of ENDS and 7700 unique flavors of e-liquids available in the market. The global vaporizers, e-cigarettes and other ENDS market is expected to grow from $11.7 billion 2020 to $14.33 billion in 2021.

Generally, ENDS include an electrically powered heater to aerosolize a liquid containing nicotine, a solvent (e.g., propylene glycol and/or vegetable glycerin), and flavorants. However, with the steadily growing demand for ENDS, new and more advanced ENDS are continually introduced to the market. These new ENDS are accompanied by new versions of various e-liquids, which are available in a variety of flavors and nicotine concentration. Due to considerable heterogeneity of such ENDS devices, the actual amount of vapor and/or active ingredient provided to users may vary. For instance, without knowing information about ENDS device characteristics, the behavioral and health effects of electronic cigarette (ECIG) use remain difficult to determine.

Thus, it is of great interest to regulate and assess various ENDS and related paraphernalia, in particular, the commercial availability of an overwhelming variety of ENDS and e-liquids which have potential health/safety implications due to the effects of inhaled substance (e.g., nicotine, which is known as a highly addictive substance). To date, no extensive analysis has been conducted on the design of ENDS or the chemical composition of e-liquids and their effect on nicotine delivery. The assessment may be especially useful for ENDS users who may benefit by setting a solid cessation plan based on their accurately measured actual nicotine inhalation level over time. Quitting cigarettes is a difficult process for most smokers, and relapse is common, Causes of relapse are multiple, and recent work suggests that misusing e-cigarettes may be one of the risk factors for the relapse to combustible cigarettes. Whether relapse is caused by the effects of a nicotine priming dose or a larger process involving nicotine triggering of a greater response to environmental cues has not been fully established. Moreover, since the power of ECIG devices is directly related to toxicant yield, failing to assess ECIG power may complicate interpretation of measurement and assessment addressing the health effects of ECIG use. The need of various ECIG assessments is particularly relevant now given the new cases in ECIG or Vaping Product Use-Associated Lung Injury (EVALI).

Electronic cigarette (ECIG) voltage (V) and heater resistance (Ω), used to determine power ($W=V2/\Omega$), can be assessed in the lab using a multimeter; however, assessing this information through surveys is a challenge. A recent study demonstrates that ECIG users cannot reliably report this information. Of 165 ECIG users surveyed, 52% reported not knowing their device voltage and 64% did not know their device resistance. Of the 25% of participants who reported voltage and resistance, only 18% (n=30) provided values that converted to plausible power values. In this same study, most were able to report liquid nicotine concentration (90%) that aligned with the distribution of liquids in commonly marketed products. Thus, while self-report of liquid nicotine concentration may be possible, self-report of device characteristics is not an effective method of assessing device power. There are no standard methods for assessing ECIG device characteristics in community/population-based studies, despite recognition in the field that this is needed to advance research on behavioral and health effects of ECIGs. To date, attempts to determine the dosage of vapor and/or active ingredient in the nicotine containing vapor generated by different ENDS devices have been unsatisfactory. Due to many varying characteristics (e.g., power, voltage, temperature, maximum and minimum nicotine loading volume, etc.) over different types of ENDS as well as inconvenient methods of measurement, the accuracy and/or user satisfaction of assessment performed by these systems and methods is poor. In addition, obtaining assessment information from a user-friendly convenient method such as an image captured by a user terminal has yet to be developed or tested.

Some exemplary assessment system and method known in the art are described herein. U.S. Pat. Nos. 6,814,083 and 7,164,993 disclose the Clinical Research Support System (CReSS) device that is used as a means for acquiring smoking topographical information. The device is designed for measuring several parameters associated with tobacco cigarette behavior. However, the measurement of user-consumed nicotine vapor provided by individual ENDS is not contemplated.

U.S. Pat. No. 9,349,297 to Ortiz describes a method of using image recognition to analyze nutrition consumption information. The system uses a captured image to recognize the type and weight of food being consumed at each meal and record the images of food. However, an assessment of any electronic nicotine delivery system and/or measurement of nicotine containing vapor is not described.

Thus, there is a need in the art for an improved system and method to assess, monitor and record the electrical activity as well as delivered doses of vapor and/or ingredients of the ENDS in a convenient and easily accessible manner.

SUMMARY OF THE INVENTION

According to aspects of the disclosure, a system and a method for identifying and assessing electronic nicotine delivery systems (ENDS) are provided. The assessment system and method may be configured to identify and assess any commercial devices that are designed for ingestion of vapors or inhalants. The system and method occur at a computing platform including a processor and memory. The method includes receiving information regarding device characteristics and device settings (e.g., power, temperature, liquid type, or liquid amount, etc.) of an ENDS. The disclosure also includes receiving information regarding the type or amount of liquid used in ENDS. The method further includes determining, using the received information, an assessment of the device type, power setting and/or liquid type or amount. The method also includes a platform for comparison of the information sent to known product information to determine the device, type, power setting, and/or liquid type or amount.

One aspect of the disclosure provides a computer-implemented method of determining an amount of delivered active agent from an electronic vaporizer, comprising: receiving one or more inputs including at least one image of the electronic vaporizer from a camera on a mobile device; transmitting the at least one image to a server or system of servers, wherein the server or system of servers comprises a memory having an image database comprising i) a plurality of images associated with a plurality of electronic vaporizers and ii) device information associated with each of the plurality of electronic vaporizers; identifying the electronic vaporizer from a match with at least one image of a plurality of the images in the image database, wherein the identifying step produces an identified electronic vaporizer; and using at least a portion of the device information for the identified electronic vaporizer to compute an amount of active agent delivered by the identified electronic vaporizer by using one or more processors. In some embodiments, the device information is selected from the group consisting of type of vaporizer, voltage, heater resistance, power, type of liquid, maximum refillable amount of liquid, maximum concentration of liquid, and combinations thereof. In preferred embodiments, the electronic vaporizer is an electronic nicotine delivery system (ENDS) device. In some embodiments, the one or more inputs received on a mobile device may be selected from the group consisting of a text message, a voice recording, a video, a user interface, a data file and combinations thereof. In some embodiments, the method may further comprise the steps of receiving a first image of a level of liquid prior to consumption by a user and a second image of a remaining level of liquid after consumption by the user; determining a volume of active agent delivered to the user based on a difference in liquid levels between the first image and second image, wherein the using step uses the at least a portion of the device information in combination with the volume of active agent determined in the determining step.

Another aspect of the disclosure provides a non-transitory computer readable medium that comprises computer executable instructions embodied in the computer readable medium that when executed by a processor of a computer control the computer to perform steps comprising: receiving one or more inputs including at least one image of the electronic vaporizer from a camera on a mobile device; transmitting the at least one image to a server or system of servers, wherein the server or system of servers comprises a memory having an image database comprising i) a plurality of images associated with a plurality of electronic vaporizers and ii) device information associated with each of the plurality of electronic vaporizers; identifying the electronic vaporizer from a match with at least one image of a plurality of the images in the image database, wherein the identifying step produces an identified electronic vaporizer; and using at least a portion of the device information for the identified electronic vaporizer to compute an amount of active agent delivered by the identified electronic vaporizer by using one or more processors. In some embodiments, the device information is selected from the group consisting of type of device, voltage, heater resistance, power, type of nicotine, maximum refillable amount of liquid nicotine, maximum concentration of liquid nicotine, and combinations thereof. In preferred embodiments, the electronic vaporizer is an electronic nicotine delivery system (ENDS) device. In some embodiments, the one or more inputs received on a mobile device further include inputs selected from the group consisting of a text message, a voice recording, a video, a user interface, a data file and combinations thereof. In some embodiments, the computer executable instructions further comprise steps of: receiving a first image of a level of liquid prior to consumption by a user and a second image of a remaining level of liquid after consumption by the user; determining a volume of active agent delivered to the user based on a difference in liquid levels between the first image and second image, wherein the using step uses the at least a portion of the device information in combination with the volume of active agent determined in the determining step.

Yet another aspect of the disclosure provides a system for determining an amount of delivered active agent from assessing an electronic vaporizer, comprising: a remote server or system of remote servers in communication with a mobile device configured to capture at least one image of the electronic vaporizer, wherein the remote server or system of remote servers is operatively coupled to one or more processors and a memory having an image database comprising i) a plurality of images associated with a plurality of electronic vaporizers and ii) device information associated with each of the plurality of electronic vaporizers and wherein the remote server or system of remote servers is configured to: receive the at least one image of the electronic vaporizer; identify the electronic vaporizer from a match with at least one image of a plurality of images in the image database to produce an identified electronic vaporizer; and use at least a portion of the device information for the identified electronic vaporizer to compute an amount of active agent delivered by the identified electronic vaporizer by using the one or more processors. In some embodiments, the remote server or system of remote servers is further configured to receive a first image and a second image, wherein the first image includes a level of liquid to be consumed by the user and the second image includes a level of liquid after a partial or complete liquid consumption by the user; determine a volume of active agent delivered to the user based on a difference in liquid levels between the first image and second image; and use the at least a portion of the device information in combination with the volume of active agent determined to compute an amount of active agent delivered by the identified electronic vaporizer by using the one or more processors. In some embodiments, the device information is selected from the group consisting of type of vaporizer, voltage, heater resistance, power, type of liquid, maximum refillable amount of liquid, maximum concentration of liquid, and combinations thereof. In preferred embodiments, the electronic vaporizer is an electronic nicotine delivery system (ENDS) device. The remote server or system of remote servers is further configured to analyze the volume of nicotine consumed by the user over a fixed time period for determining an estimate of nicotine consumption metric. Additionally, the remote server or system of remote servers is further configured to receive one or more inputs from a user of the mobile device describing the electronic vaporizer and to transmit the at least a portion of the device information to the mobile device via a user interface, a text message, a social networking message, a phone call, an automated voice message, a display, or any combination thereof. In some embodiments, the one or more inputs are a text message, a voice recording, a video, a user interface, a data file or any combination thereof.

In some embodiments, a platform whereby the vaporizer user will be able to use a smartphone app (i.e., application software) to take a picture of their device and/or the settings they are using. The app will also allow users to enter the vaporizer device or setting details, in the case that they are not easily ascertained from images. In addition, the app will allow quantification of the amount of liquids consumed by allowing users to capture images of the vaporizer-loadable liquid when they purchase liquid and subsequently capture images of the remaining liquids when they finish. These data will be used to estimate the liquid consumption over a discrete period of time.

Additional features and advantages of the present invention will be set forth in the description of disclosure that follows, and in part will be apparent from the description of may be learned by practice of the disclosure. The disclosure will be realized and attained by the compositions and methods particularly pointed out in the written description and claims hereof.

DETAILED DESCRIPTION

Figure 1:
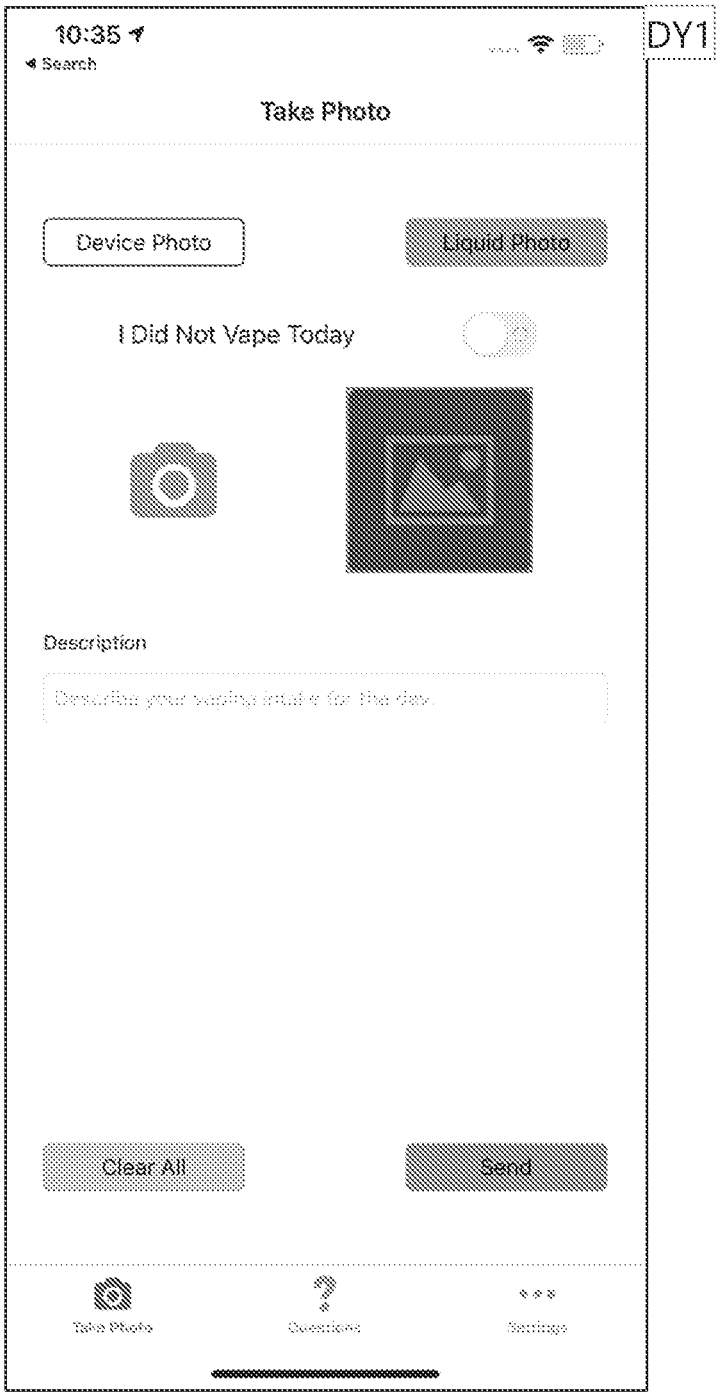
FIG. 1 shows an exemplary user interface for an image input for identification of a nicotine delivery device according to an embodiment of the subject matter described in the disclosure.

The preferred embodiments of the present disclosure are directed toward an assessment system and a method for identifying and assessing a commercial device that is designed for ingestion of vapors or inhalants. The assessment system and method of the present disclosure may be used for any liquid-to-vapor delivery system or device. In particular, the system and method are directed toward a commercial nicotine delivery device, e-cigarette (ECIG).

In preferred embodiments, the system will allow ECIG users to capture images of ECIG devices and ECIG liquids, as well as allow user to input any device-related information. The data will be sent to a server in real-time where an operator or a computing platform will be able to: 1) match user's device images with product images with known information regarding the device's operating voltage (V) and heater resistance; and 2) identify the user's ECIG liquid(s) to determine its nicotine content and flavor. The device and ECIG liquid databases will be "living databases" that can be updated continuously from available produce databases and from information (e.g., images) sent by users. This method offers a meaningful and significant advancement from current methods that rely on self-report.

One aspect of the disclosure provides a system for assessing an electronic liquid-to-vapor delivery device or a vaporizer, comprising: a mobile device having a built-in camera, the mobile device being configured to capture at least one image of the vaporizer; and a remote server or system of remote servers in communication with the mobile device, wherein the remote server or system of remote servers is operatively coupled to a processor and a memory having an image database that are configured to: receive the at least one image of the vaporizer; identify the electronic liquid-to-vapor delivery device from a match with at least one image of a plurality of images in the image database; and assess device information associated with the electronic liquid-to-vapor delivery device. In some embodiments, the mobile device is configured to capture a first and a second images, wherein the first image includes a level of liquid to be consumed by the user and the second image includes a level of liquid after a partial or complete liquid consumption by the user; In some embodiments, the device information associated with the electronic vaporizer is type of device, voltage, heater resistance, power, type of liquid, maximum refillable amount of liquid and maximum concentration of liquid.

Another aspect of the disclosure provides a non-transitory computer readable medium that comprises computer executable instructions embodied in the computer readable medium that when executed by a processor of a computer control the computer to perform steps comprising: receiving one or more inputs including at least one image of the electronic vaporizer from a camera on a mobile device; transmitting the at least one image to a server or system of servers, wherein the server or system of servers comprises a memory having an image database comprising i) a plurality of images associated with a plurality of electronic vaporizers and ii) device information associated with each of the plurality of electronic vaporizers; identifying the electronic vaporizer from a match with at least one image of a plurality of the images in the image database, wherein the identifying step produces an identified electronic vaporizer; and using at least a portion of the device information for the identified electronic vaporizer to compute an amount of active agent delivered by the identified electronic vaporizer by using one or more processors. In some embodiments, the device information is selected from the group consisting of type of device, voltage, heater resistance, power, type of nicotine, maximum refillable amount of liquid nicotine, maximum concentration of liquid nicotine, and combinations thereof. The one or more inputs received on a mobile device further include inputs selected from the group consisting of a text message, a voice recording, a video, a user interface, a data file and combinations thereof. In some embodiments, the computer executable instructions further comprise steps of: receiving a first image of a level of liquid prior to consumption by a user and a second image of a remaining level of liquid after consumption by the user; determining a volume of active agent delivered to the user based on a difference in liquid levels between the first image and second image, wherein the using step uses the at least a portion of the device information in combination with the volume of active agent determined in the determining step.

In preferred embodiments, the electronic vaporizer is an electronic nicotine delivery system (ENDS). The system includes a computing platform, which is configured to estimate amounts of level of liquid nicotine in the first and second images; and calculate a volume of nicotine consumed by the user with reference to a difference between the estimated amount of the level of liquid nicotine from the first image and the estimated amount of the level of liquid nicotine from the second image. The computing platform may be further configured to analyze the volume of nicotine consumed by the user over a fixed time period for determining an estimate of nicotine consumption metric. In some embodiments, the mobile device is configured to receive one or more inputs such as a text message, a voice recording, a video, a user interface, a data file or any combination thereof from the user describing the electronic liquid-to-vapor delivery device. The mobile device is further configured to provide the assessed device information to the user via a user interface, a text message, a social networking message, a phone call, an automated voice message, a display, or any combination thereof.

The term "mobile device", as used herein, refers to a portable terminal such as a smartphone, a tablet PC, a notebook type PC, a portable digital assistant (PDA), and a personal media player (PMP), a fixed terminal such as a desktop PC, and a wearable device such as a smartwatch, a smart glasses and a head-mounted-device (HMD). In operation, the mobile device may obtain an image by capturing an image with a camera mounted thereon or receiving the image from another electronic device. In addition, a plurality of other features including a text message, a voice recording, a video, a user interface, a data file or any combination thereof may be uploaded or inputted to the mobile device by a user. The mobile device may then extract features associated with an object depicted in the obtained image and transmit the features to a server or a system of servers. According to various embodiments of the present disclosure, in addition to the features extracted from the image, the mobile device may further transmit additional information associated with the image and/or user information associated with the device. The communication between the mobile device and a system of servers may be through a wired or wireless network (e.g., the Internet, a Local Area Network, a Wide Area network, etc.). In preferred embodiments, the server or a system of servers are remote servers that are operatively connected through a wireless network. Some exemplary types of mobile and relevant electronic device are described in U.S. Pat. No. 9,953,248, herein incorporated by reference.

In some embodiments, the mobile device may include an app that uses a user interface system to allow the nicotine delivery device information to be inputted by users. The app may also allow users to log consumption activities, such as puffing or vaping, and log such activities in a fixed period of time, for example, hourly, daily, weekly, or monthly. A wireless accelerometer or other sensor may be used for logging activity information via wireless transmittal or electronic transfer. In some embodiments, the mobile device may display a feature that allow organizing and providing a user's logged data and information about their estimated nicotine intake. The mechanism may generate a report (e.g., such as a text document or a visual diagram) for quickly identifying issues and/or accomplishments and may be provided to a user, a physician, an intervention counselor, or other relevant person. In particular, in some embodiments, the system and/or method of the present disclosure is configured to provide feedback to a user, a researcher or an interventionist on the estimated nicotine intake based on recorded data and/or to what degree this amount is harmful or potentially helpful at reducing combustible cigarette use.

The input and/or images are analyzed by using one or more processors that are operatively connected to a remote backend server or a system of servers. Each of the processors may include any suitable type of processing circuitry, such as one or more general-purpose processors (e.g., ARM-based processors), a Digital Signal Processor (DSP), a Programmable Logic Device (PLD), an Application-Specific Integrated Circuit (ASIC), a Field-Programmable Gate Array (FPGA), etc.

In certain embodiments, the mobile device described herein may include a user interface feature. In certain embodiments, the user interface is a display. In certain embodiments, the display is a liquid crystal display (LCD), In certain embodiments, the display is a light emitting diode (LED). In certain embodiments, the display is an organic light emitting diode (OLED). In certain embodiments, the display provides a user interface. In certain embodiments, the display is touch sensitive. In certain embodiments, the display communicates an amount of total particulate mass (TPM) vaporized, amount of active ingredient vaporized, or any combination thereof. In certain embodiments, the display allows the user to select the type of vaporizable material as well as type or feature of a vaporizer. In certain embodiments, the display allows the user to select the characteristics (e.g., power, voltage, temperature, etc.) or identification (e.g., model number, serial number, manufactured year, manufacturing company, etc.) of the vaporizer. In certain embodiments, the electronic vaporizer device utilizing the method comprises a user interface controller. In certain embodiments, the user interface controller is communicatively coupled to the display. In certain embodiments, the user interface controller is a software module that controls information communicated via the display. The data and/or information received by user interface may be sent to a processor or a memory which are operatively connected to a server or a system of servers.

The server or system of servers may receive and obtain the images and analyze information related to the object depicted in the image by analyzing the features, the additional information, and/or the user information received from the mobile device. The server may then transmit the analysis information (or analysis result) back to a device (e.g., preferably the mobile device which was used to input the images) to display the result to a user. The term "user" in this disclosure may refer to a person using an electronic device or a device using an electronic device (for example, an artificial intelligence (AI) electronic device). The term "memory unit," as used herein, refers to a non-transitory computer readable medium, software or algorithm for data storage. In certain embodiments, a memory unit is a solid state device. In certain embodiments, a memory unit is internal to the device. In certain embodiments, a memory unit stores data in random access memory (RAM). In certain embodiments, a memory unit is a hard disk, tape drive, or other external device. In certain embodiments, a memory unit refers to a device configured as a permanent holding place for digital data, until purposely erased. A memory unit also refers to devices configured as non-volatile memory chips such as flash, Read-Only memory (ROM) and/or Electrically Erasable Programmable Read-Only Memory (EEPROM). In some embodiments, the user interface can be configured to allow a user to change and/or monitor the user settings in the app of the mobile device. For example, in one embodiment, user control means can be used to track the usage of the app or the vaporizer, relative to any of calculated total particulate mass (TPM), voltage or heat temperature, singly or in combination.

The term "liquid-to-vapor device", "vaporizer" or "inhalation device" may be interchangeably used and refer to a device which uses aerosolized vapor instead of smoke. The vaporizer includes a heating element, which may be in thermal communication with another mechanism. A vaporizable material may be placed directly in a heating element or in a cartridge fitted in the device. The heating element in thermal communication may heat a vaporizable material mass in order to create a gas phase vapor. The heating element may heat the vaporizable material through conductive, convective, and/or radiative heat transfer. The vapor may be released to a vaporization chamber where the gas phase vapor may condense, forming an aerosol cloud having typical liquid vapor particles with particles having a diameter of average mass of approximately 0.1-1 micron or greater. As used herein, the term "vapor" may generally refer to a substance in the gas phase at a temperature lower than its critical point. The vapor may be condensed to a liquid or to a solid by increasing its pressure without reducing the temperature. The term "vape" or "vaping", as used herein, refers to the action of or the experience of using a vaporization device, such as an electronic vaporizer device for the delivery of vapor to a user. The term "vaporizable material", as used herein, refers to a formulation of material, including in particular an organic material or botanical that is placed in a vaporization device, electronic vaporizer device, or pod (or a proprietary container) that houses the formulation. The vaporizable material can be a liquid, oil, or wax. In certain embodiments, the vaporizable material is a loose leaf substance. In certain embodiments, the vaporizable material can contain medicinal properties that ameliorate symptoms of a medical condition. In certain embodiments, the vaporizable material can contain a recreational drug. In preferred embodiments, the vaporizable material is nicotine-containing substance.

The term "nicotine" as used herein refers to nicotine, nicotine salts of organic acid, and common nicotine derivatives such as; norcotinine, nornicotine, nicotine N-oxide, cotinine N-oxide, 3-hydroxycotinine and 5-hydroxycotinine. The term "puff" refers to the process of removing vapor from a vaporization device or e-vaporizer device using a suction mechanism. In certain embodiments, the suction mechanism is a user. In certain embodiments, the suction mechanism is an analytical smoking machine. Commonly used synonyms for puff are drag, draw, hit, suck, pull, inhale, or smoke for example. As used herein a "dose" may refer to the amount or quantity of the vapor and/or material (e.g., active ingredient(s), etc.) taken at a particular time. The dose may be quantified as a mass, or a mass/time, depending on the context. The dose may be dose/puff. A "fixed time period" is defined herein as a plurality of time periods defined by a user or others for various intended uses; for example, the fixed time period may refer to an inter-puff interval, a time to finish total inhalation material, a time between the first puff and removal of inhalation material, a particular time set by the user, a planned smoking cessation time period, or any combination thereof. A fixed period of time may be days (e.g., 2, 3, 4, 5, 6 or 7 days), weeks (e.g., 1, 2, 3 or 4 weeks), months (e.g., 1, 2, 3, 4, 5, 6 months), or years (e.g., 1, 2, 3, 4 or more years).

Referring to FIG. 1, an exemplary user interface for providing ENDS information according to an embodiment of the subject matter described herein. In some embodiments, user interface may be provided to a user via an application, a game, or other software executing on a processor of a mobile device (e.g., a mobile phone or tablet computer) or a computing platform (e.g., a web server). User interface of the present disclosure may be usable (e.g., by a user) for providing, receiving, and/or viewing diet information. For example, as shown in FIG. 1, selectable icons for uploading or sending one or more pictures of the ENDS device to a server are provided. In some embodiments, the selectable icons are configured to include additional information such as descriptions of device names, device types, liquid nicotine amounts, or other nicotine related information. In some embodiments, ENDS device information may be represented using colors, numbers, letters, or other symbols. To use the feature for calculating an amount of nicotine consumption over a certain period of time, the system may have a clickable icon where it allows a user to indicate that the user did not use the device on a specific day.

Figure 2:
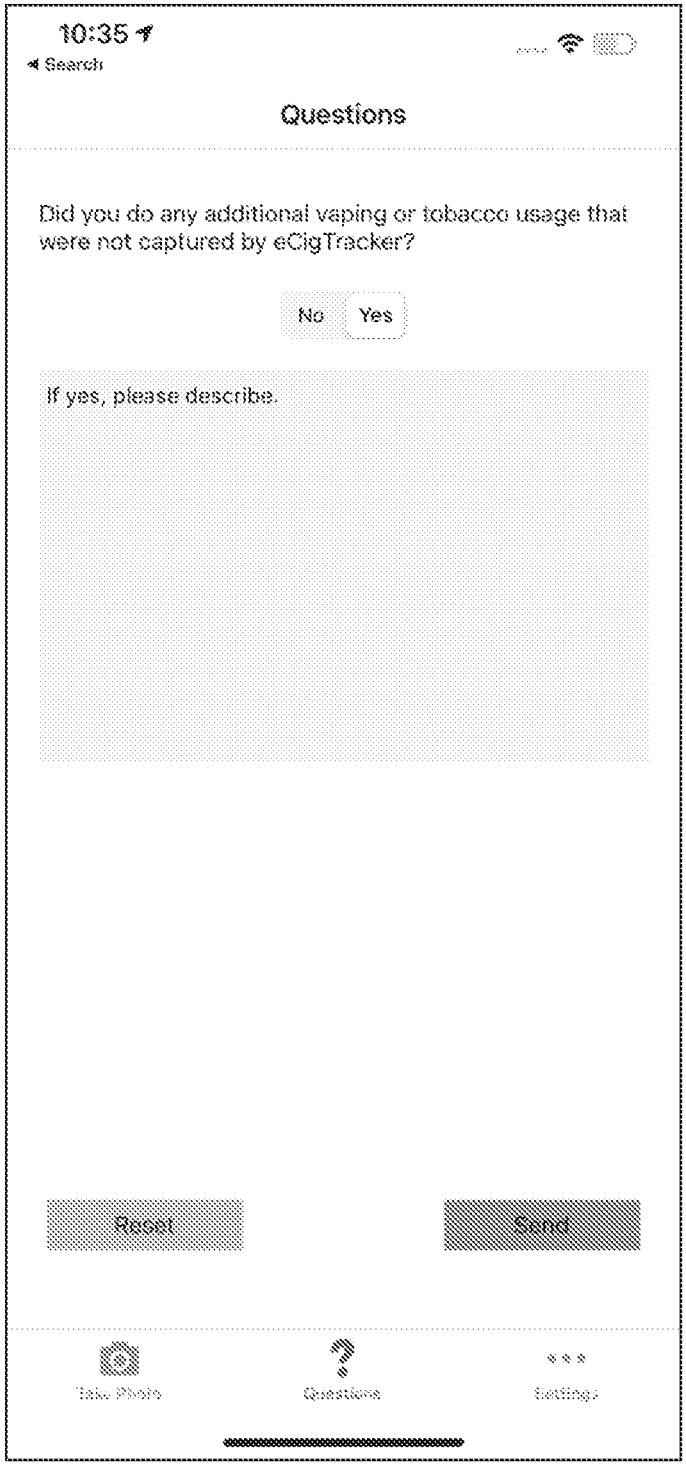
FIG. 2 shows an exemplary user interface for a text style input with a questionnaire and a comment section according to an embodiment of the subject matter described in the disclosure.
Figure 3:
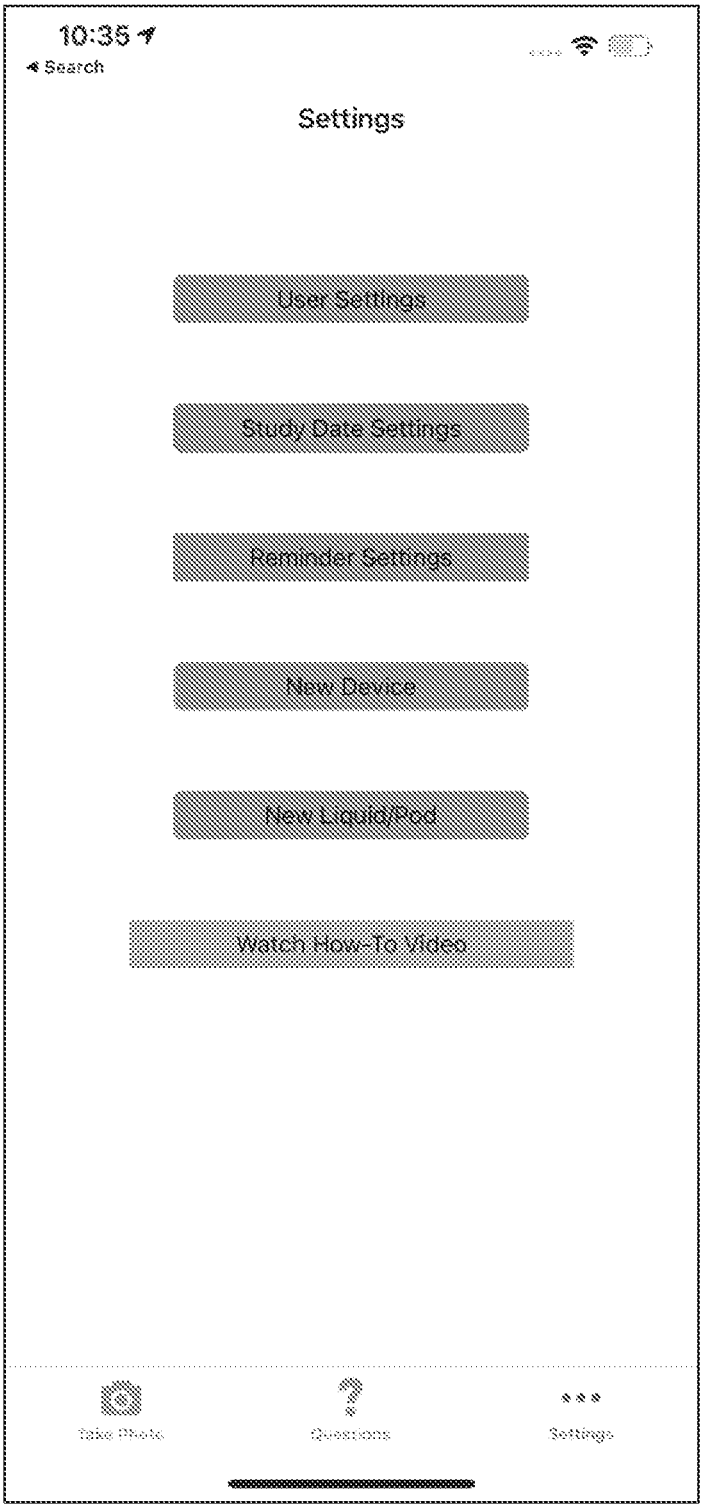
FIG. 3 shows an exemplary control setting feature of the smart phone application according to an embodiment of the subject matter described in the disclosure.
Figure 4:
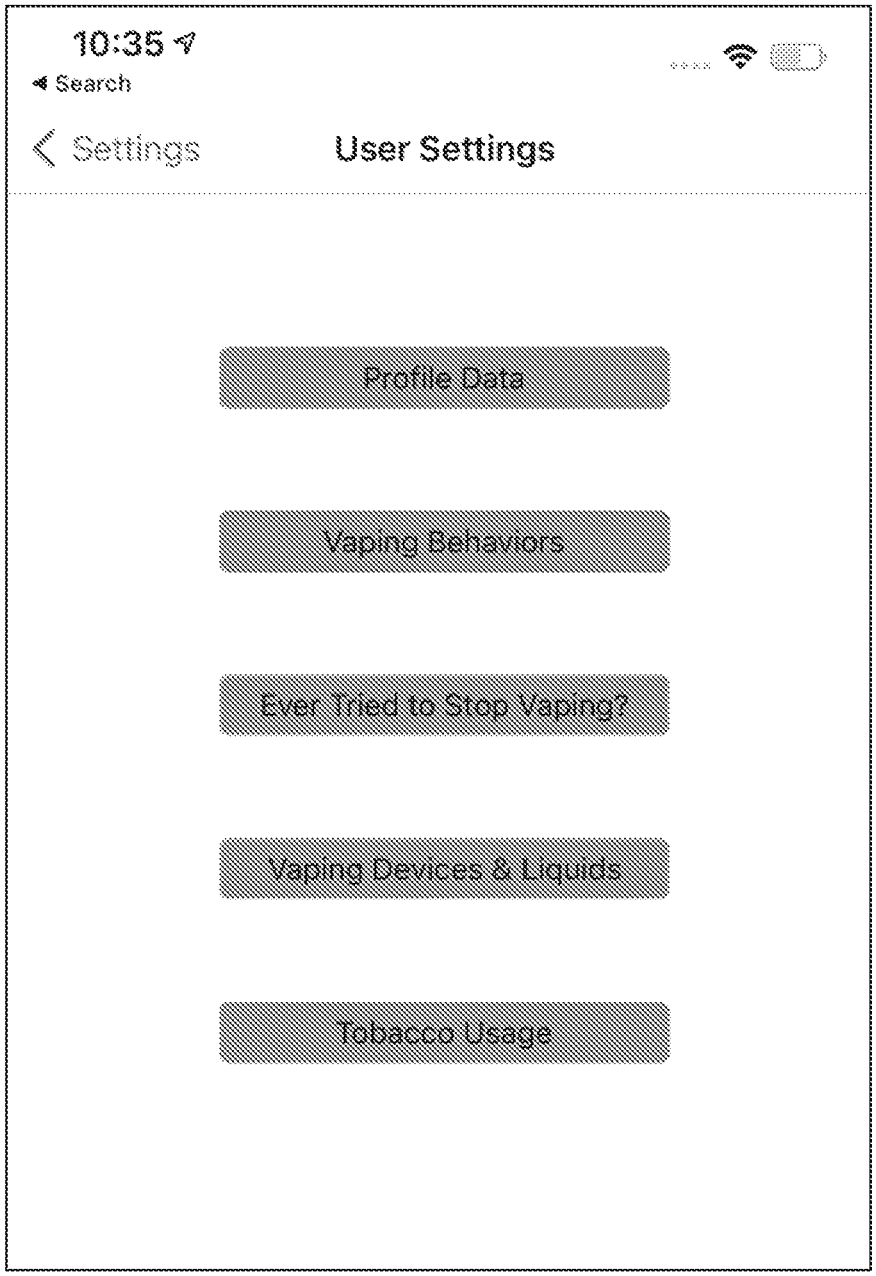
FIG. 4 shows another user control setting feature of the smart phone application according to an embodiment of the subject matter described in the disclosure.

Referring to FIG. 2, additional nicotine consumption tracker element may be usable for indicating any amounts of additional vaping or tobacco usage that are not captured by the application. For example, a user may click or select the "Yes" or "No" icon and may describe additional information in a text box. As shown in FIG. 3, a plurality of setting controls may be provided in the mobile phone application to set parameters or input new information in a general setting, study date setting, a reminder setting, a new device setting, or a new liquid/pod setting section. Also included is a "watch how-to video" for a basic introduction and method of use of the application. In a "user settings" element, profile data, vaping behaviors, vaping devices and liquids and tobacco usage information may be inputted into the system (FIG. 4). A "ever tried to stop vaping" element may be usable for indicating previous attempts in cigarette cessation or related experiences through inputting information via uploading text and/or images or a user interface questionnaire.

Figure 5:
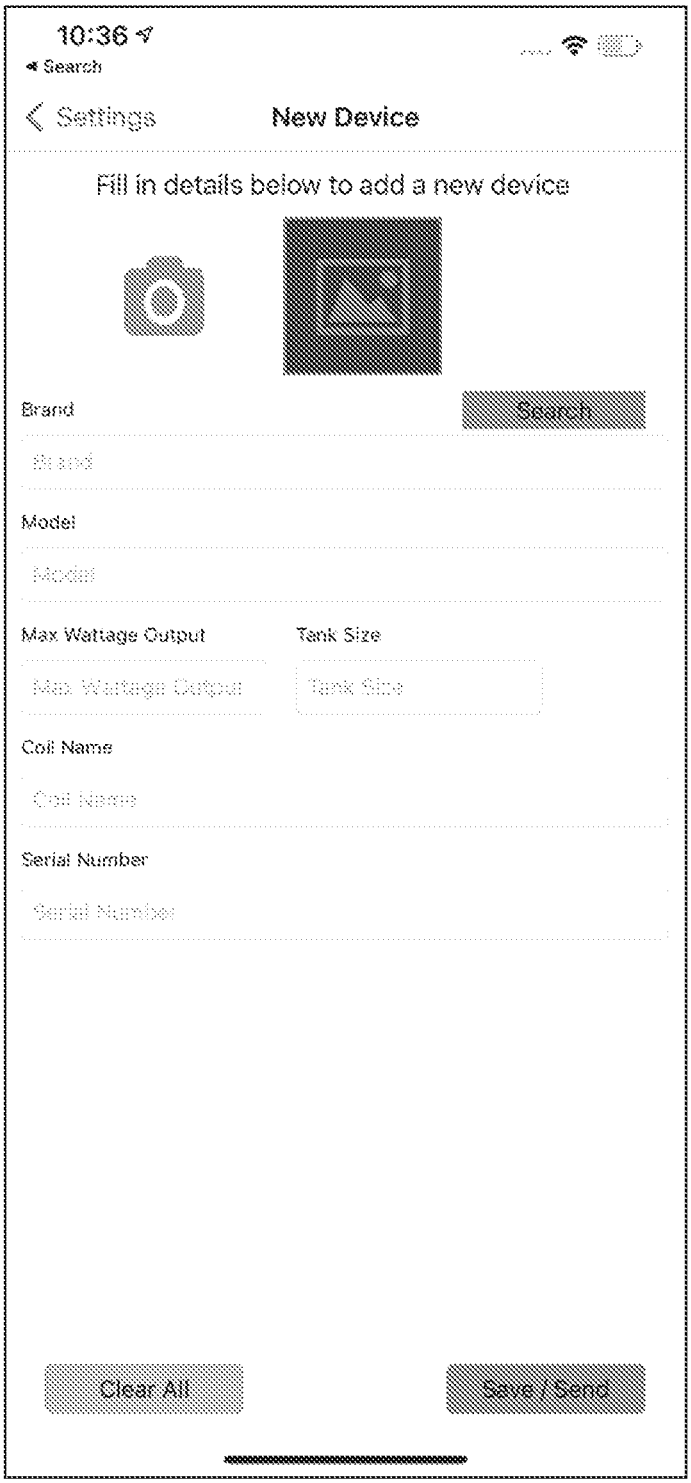
FIG. 5 shows an exemplary user interface for an image and text style for inputting information of a new nicotine delivery device according to an embodiment of the subject matter described in the disclosure.
Figure 6:
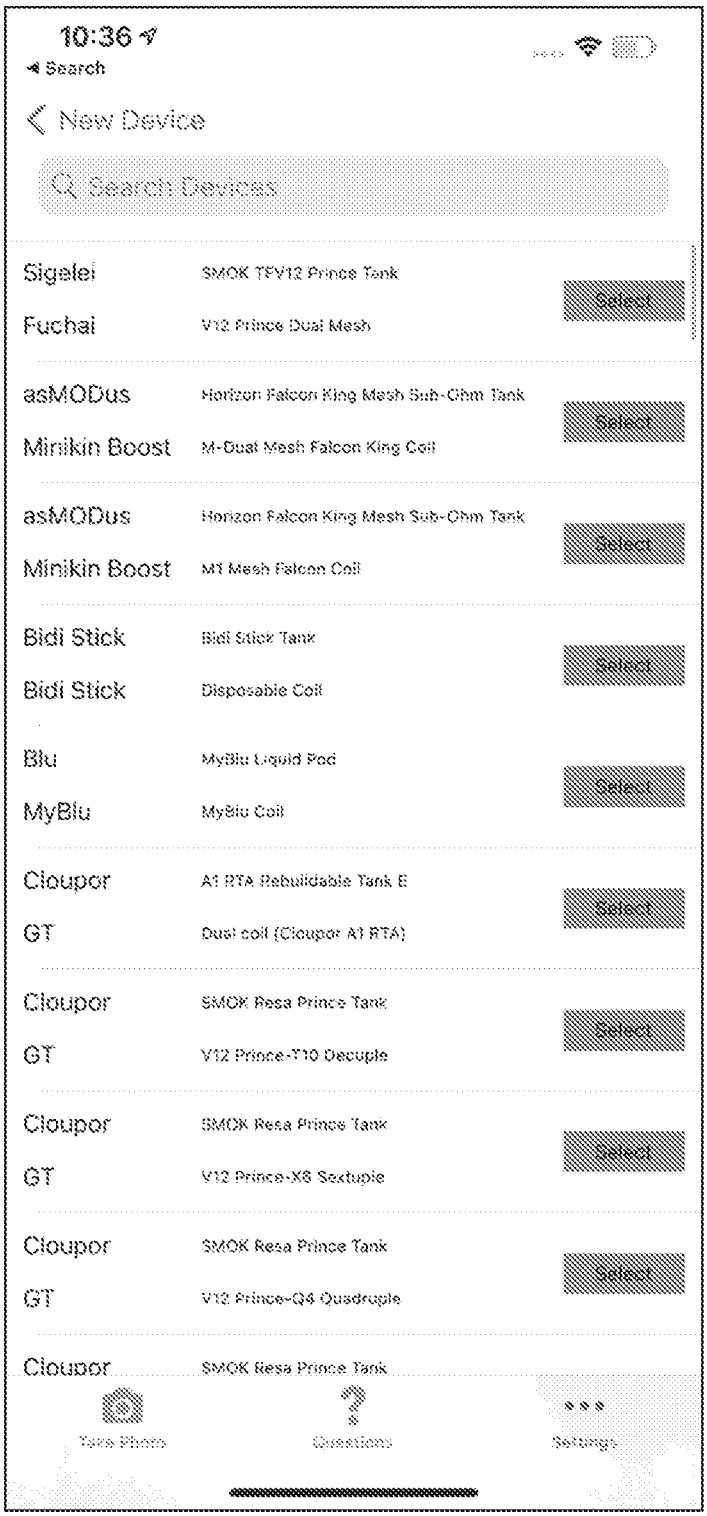
FIG. 6 shows an exemplary user interface with a new device selection list according to an embodiment of the subject matter described in the disclosure.
Figure 7:
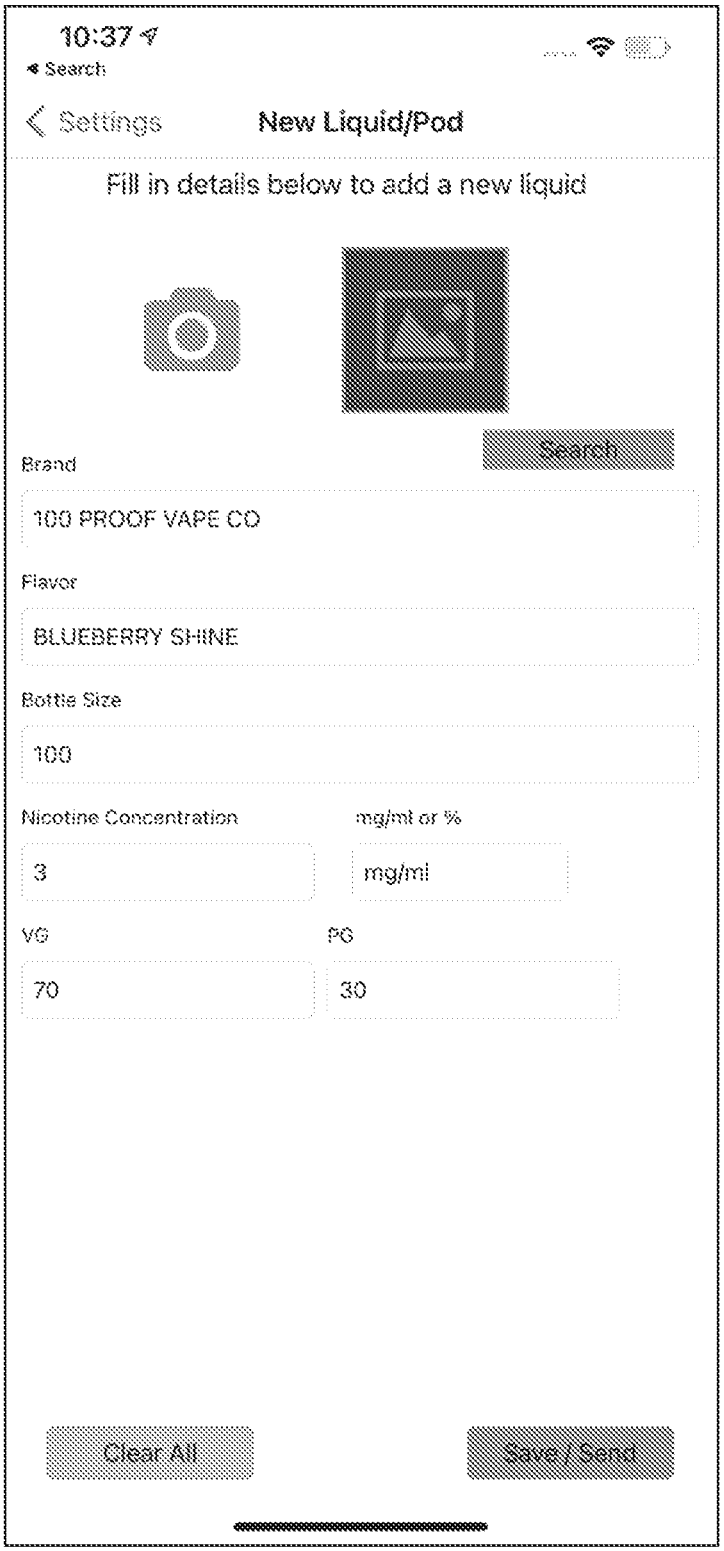
FIG. 7 shows an exemplary user interface for an image and text style for inputting information of a new liquid and/or pod of a nicotine delivery device according to an embodiment of the subject matter described in the disclosure.
Figure 8:
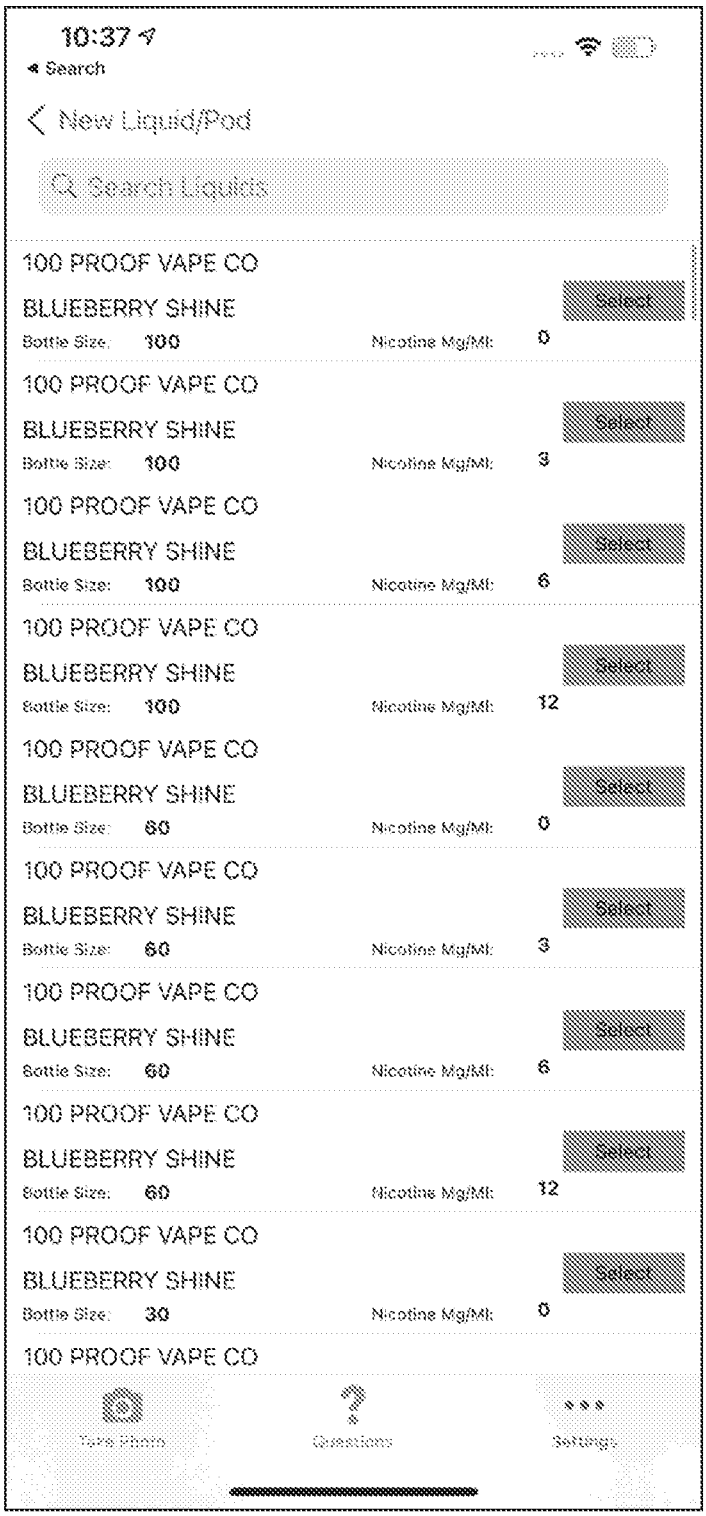
FIG. 8 shows an exemplary user interface with a new liquid and/or pod selection list according to an embodiment of the subject matter described in the disclosure.

Referring to FIG. 5, a user may select "a new device" element in a "user settings" section to upload at least one picture of the new device for identifying and/or assessing the device. The user may also directly input text information about a brand, a model, a maximum wattage output, a tank size, a coil, and a serial number of the new ENDS device. For convenience, the user may press a "search" button in a brand section to find a matching device name and/or a manufacturing company information in a provided index. Exemplary index of ENDS devices stored in a remote server or system of servers is shown in FIG. 6. The "New liquid/pod" element may also allow a user to upload one or more pictures of liquid nicotine or liquid nicotine-loaded device via selecting a camera function of the system. When the pictures of a commercial ENDS device or a new loaded liquid nicotine or a pod are uploaded, the application is configured to identify, index, and assess the ENDS device to provide a brand name, a flavor, a bottle size, a nicotine concentration in mg/ml or %, VG (vegetable glycerin) and a PG (propylene glycol) information (FIG. 7). Alternatively, also provided through a search feature, a bottle size and a corresponding nicotine mg/ml information may be searched through an index of predetermined values that match an ENDS device. Exemplary liquid nicotine/pod index is shown in FIG. 8. The terms used in the system of the present disclosure are used to describe functions or characteristics of the ENDS device and are not intended to be limited to specific wording listed herein.

Figure 9:
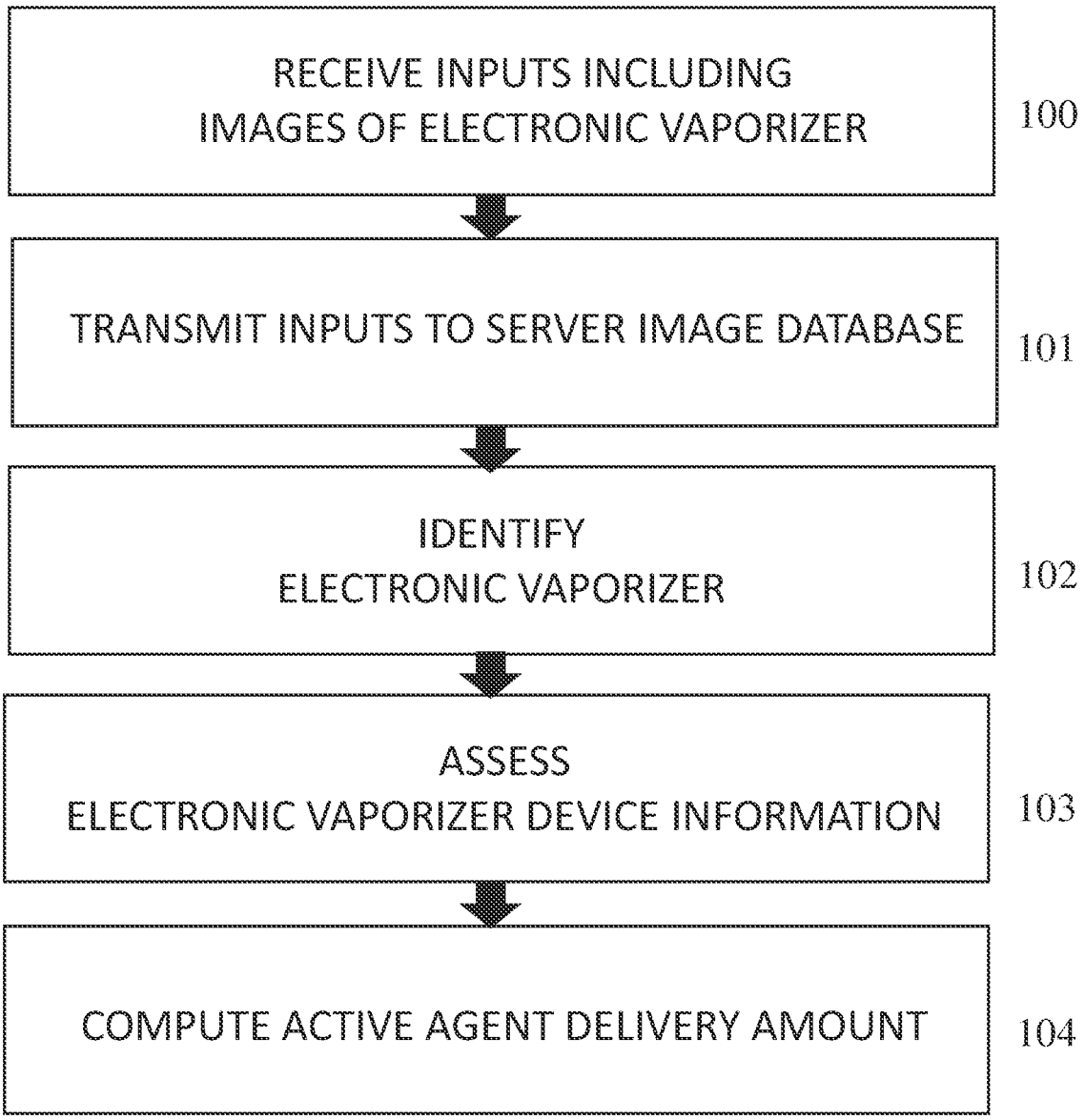
FIG. 9 shows a flowchart illustrating an exemplary process for identifying and assessing an electronic vaporizer according to an embodiment of the subject matter described in the disclosure.

Yet another aspect of the disclosure provides a computer-implemented method of determining an amount of delivered active agent from an electronic vaporizer. As shown in FIG. 9, an exemplary method for assessing an electronic vaporizer and determining an amount of active agent delivery according to an embodiment of the subject matter is described herein. The method comprises the steps of receiving 100 one or more inputs including at least one image of the electronic vaporizer from a camera on a mobile device; transmitting 101 the at least one image to a server or system of servers, wherein the server or system of servers comprises a memory having an image database comprising i) a plurality of images associated with a plurality of electronic vaporizers and ii) device information associated with each of the plurality of electronic vaporizers; identifying 102 the electronic vaporizer from a match with at least one image of a plurality of the images in the image database, wherein the identifying step produces an identified electronic vaporizer; and using at least a portion of the device information 103 for the identified electronic vaporizer to compute 104 an amount of active agent delivered by the identified electronic vaporizer by using one or more processors. In some embodiments, in step of 103, the device information is selected from the group consisting of type of vaporizer, voltage, heater resistance, power, type of liquid, maximum refillable amount of liquid, maximum concentration of liquid, and combinations thereof. The one or more inputs received 100 on a mobile device may be selected from the group consisting of a text message, a voice recording, a video, a user interface, a data file and combinations thereof. In some embodiments, the method may further comprise the steps of receiving a first image of a level of liquid prior to consumption by a user and a second image of a remaining level of liquid after consumption by the user; determining 104 a volume of active agent delivered to the user based on a difference in liquid levels between the first image and second image, wherein the using step uses the at least a portion of the device information in combination with the volume of active agent determined in the determining step. The method may also further comprise a step of displaying or communicating the determined information to a user via a user interface, a text message, a social networking message, a phone call, an automated voice message, a display, or any combination thereof.

As used in step 102, the term "identifying" may refer to methods of analyzing a vaporizer so that a unique and defined name or a type may be associated with the vaporizer, and is meant to include indexing, detecting, measuring, analyzing, screening, and assessing the vaporizer. For example, the identifying step may refer to a process of looking at the vaporizer image, which permits identifying the vaporizer with specificity (e.g., which make and model), and such identification may also include "indexing" the vaporizer (e.g., relating it to known vaporizers whose images are in a database and compiling images or information about the identified vaporizer in an inventory, a catalog or an index in the database) and/or "assessing" the vaporizer (e.g., obtaining known information about the identified vaporizer from a match determination and/or noting characteristics of the vaporizer from its image).

In preferred embodiments, the electronic vaporizer is an electronic nicotine delivery system (ENDS) device. In these embodiments, a computer-implemented method of determining an amount of delivered nicotine from an electronic nicotine delivery device is provided, comprising: obtaining 100 one or more inputs such as a text message, a voice recording, a video, a user interface, a data file or any combination thereof, including at least one image of the electronic nicotine delivery device using a camera; transmitting 101 the at least one image to a server or system of servers, wherein the server or system of servers comprises a memory having an image database comprising i) a plurality of images associated with a plurality of electronic nicotine delivery devices and ii) device information associated with each of the plurality of electronic nicotine delivery devices; identifying 102 the electronic nicotine delivery device from a match with at least one image of a plurality of the images in the image database, wherein the identifying step produces an identified electronic nicotine delivery device; and using at least a portion of the device information 103 for the identified electronic nicotine delivery device to compute 104 an amount of nicotine delivered by the identified electronic nicotine delivery device by using one or more processors. In step 103, the device information is selected from the group consisting of type of device, voltage, heater resistance, power, type of nicotine, maximum refillable amount of liquid nicotine, maximum concentration of liquid nicotine, and combination thereof. The method may further include receiving a first image of a level of liquid nicotine prior to consumption by a user and a second image of a remaining level of liquid nicotine after consumption by the user; determining a volume of nicotine delivered to the user based on a difference in liquid nicotine levels between the first image and second image, wherein the using step uses the at least a portion of the device information in combination with the volume of nicotine determined in the determining step.

In some embodiments, the assessment of a nicotine delivery device "type" (e.g., disposable, rechargeable) may be based on a user-report. Images are used to cue respondents' memory (e.g., in the Population Assessment of Tobacco and Health study). In general, first-generation devices deliver less nicotine compared to second- and third-generation devices. However, differentiating ECIGs based on type may still be problematic, because rechargeable or modular devices can be operated at low power, leading to little or no nicotine or toxicant emissions. In such cases, the users may be asked to report on the voltage and resistance of their device.

According to an embodiment of the present disclosure, the one or more image processors may identify the respective types of images of a nicotine delivery device obtained by the input acquisition device (i.e., mobile device) based on at least one standard image stored in the image database connected to a remote server. For example, an image processor may generate a score indicating a degree of similarity between an obtained image and the standard image for a particular type of images (e.g., category) and determine that the obtained image is of the same type as the standard image based on the score. In other words, the image processor may classify the obtained image into a particular category by comparing the obtained image with one or more standard images that are retrieved from the image database. The image processor may extract features from the classified image. In some embodiments, the image database may store at least one standard image of a particular type of nicotine delivery device.

For example, the mobile device connected to a processor and a remote server may extract features from an image depicting one or more angles or at least one image feature of the nicotine delivery device and receive analysis information from the server after indexing and identifying the nicotine delivery device. In some embodiments, the method may include a step of cropping or selecting a portion of the obtained image that includes a particular angle of the nicotine delivery device to calculate a feature corresponding to the device on the cropped portion.

Additional information may be included at least one of metadata of the image, an indication of a time when the image is obtained and an indication of a location where the image is obtained. For example, the metadata may include the type, sensitivity, exposure information, shooting date and time, ISO value, focal length or resolution of a shooting camera so that the image and image acquisition information may be transferred to another mobile device or to a server.

The system and method of the present disclosure may be used in clinical and research settings when it is important to be able to objectively determine, in field settings, the toxicant exposure or nicotine consumption from an ECIG or ENDS device over a discrete period of time. The technology and method could also be used in consumer settings where consumers may be interested in tracking or recording their nicotine intake over time. In some embodiments, machine learning methods for image classification may be used. The method is of high interest to the U.S. Food and Drug Administration (FDA) and research community because there is an urgent need to better identifying the types of products people are using and the ways in which they are using them. Such as system would help identify e-cig products (devices and liquids) that might be contributing to lung injury.

As described above, the vaporizer or liquid-to-vapor inhalation device may be any vaporization devices that comprise any vaporizable materials. The vaporizable material may be contained in a cartridge or the vaporizable material may be loosely placed in one or more cavities the vaporization device. A heating element may be provided in the device to elevate the temperature of the vaporizable material such that at least a portion of the vaporizable material forms a vapor. The heating element may heat the vaporizable material by convective heat transfer, conductive heat transfer, and/or radiative heat transfer. The heating element may heat the cartridge and/or the cavity in which the vaporizable material is stored. In other preferred embodiments of the method, the tobacco or botanical is heated to about 200° C. at most. In still other embodiments of the method, the tobacco or botanical is heated to about 160° C. at most.

In some embodiments, the device information is selected from the group consisting of type of device, voltage, heater resistance, power, type of nicotine, maximum refillable amount of liquid nicotine, maximum concentration of liquid nicotine, and combination thereof. The device information may include type of liquid nicotine, tobacco or botanical filled into the device. In addition, a range of temperatures used by the device for vapor formation may also be provided by the method of the present invention. The importance of temperature information is based on the study that showed pyrolysis of tobacco or botanical does not typically occur at a low temperature (<300° C.), yet vapor formation of the tobacco or botanical components and flavoring products does occur. An aerosol produced at these temperatures also was substantially free from Hoffman analytes (e.g., acetaldehyde, acrolein, carbon monoxide, benzene, formaldehyde, 1,3-butadiene, nicotine, etc.) or at least 70% less Hoffman analytes than a common tobacco or botanical cigarette and scored significantly better on the Ames test than a substance generated by burning a common cigarette. In addition, vapor formation of the components of the humectant, mixed at various ratios also may occur, resulting in nearly complete vaporization, depending on the temperature, since propylene glycol has a boiling point of about 180-190° C. and vegetable glycerin will boil at approximately 280-290° C.

Time interval values (dose interval values) may be summed over the entire time period to determine the overall dose of vapor generated; the vaporized dose predictor unit may also then convert this dose of vapor to a dose of an active ingredient in the vapor, by, e.g., converting based on the concentration of active ingredient in the vaporizable material. U.S. patent application Ser. No. 14/581,666, incorporated by reference in its entirety, also describes vaporizers including methods and apparatuses for temperature measurement and control similar to that described above.

In some embodiments, the system and method of the present disclosure may provide information on the power source of the vaporizer which may be configured to deliver power to the heating element and may be regulated by the heater controller. The heater controller of the vaporizer may therefore receive charge/power level input from the power source and may adjust its output accordingly. In certain embodiments, the system and method may provide information on power source of the vaporizer which is configured to deliver an adjustable amount of power. In certain embodiments, based on the information provided by the system and method of the present disclosure, the amount of power is adjustable by the user. In certain embodiments, the amount of power is adjusted by the VMP unit. As mentioned, the power source may be communicatively coupled to the heater controller. In certain embodiments, the power source is configured to deliver an adjustable amount of power and is controlled by the VMP unit. In certain embodiments, the power source delivers between 1 and 100 watts of power. Other method for calculating an amount of the vaporizable material is described in detail in U.S. Pat. No. 10,512,282 to Bowen, incorporated by reference herein.

Customized smoking cessation goals may be inputted into the system of the present disclosure. The customized goals can enable the same nicotine delivery platform to be used to achieve multiple beneficial health benefits for different smokers, from full smoking cessation to partial cessation (e.g., no smoking during the workday), to partial or full nicotine cessation (i.e., stopping nicotine intake entirely), to cognition remediation. In one embodiment, the customized goals enable the same nicotine delivery platform to be used to achieve full smoking cessation. In another embodiment, the customized goals enable the same nicotine delivery platform to be used to achieve full nicotine or smoking cessation without relapse. In another embodiment, the customized goals enable the same nicotine delivery platform to be used to achieve full nicotine withdrawal without nicotine withdrawal symptoms.

In some embodiments, the method may include a Web based and mobile application tools. For example, for web-based tools, self-report measures can be used to help a smoker or new user of a device provided herein identify a target goal based on their degree of nicotine dependency, health status, health goals, economic goals (i.e., decrease the amount of money spent on cigarettes), target cessation date or change in cessation plan, or other factors. Exemplary methods and devices and computer readable medium for transitioning a smoker to an ENDS device and for smoking or nicotine cessation are described in U.S. Pat. No. 10,898,660 to Wensley, herein incorporated by reference. Tests of attentional bias for smoking stimuli, and other cognitive measures of nicotine dependency, can be assessed on the web backend or an ENDS to assess risk for relapse upon smoking cessation, which can then be used to identify a pattern of use that will minimize the odds of relapse to smoking. In some cases, biomarkers, such as nicotine receptor polymorphisms, information can also be added to a user's profile to help identify the optimal outcome for an individual user. When a mobile device is used, smoking patterns can be tracked prior to the transition to an ENDS platform, which can enable a real world, ecologically valid assessment of actual behavior to be used as a foundation for a subsequent prescribed pattern of use of an ENDS device.

By systematically tracking nicotine administration using an ENDS delivery device assessment system described herein and communicating these results to a web-based backend database, feedback to the user can be customized to help promote the achievement of certain health goals. This customized feedback can be used in multiple ways. For example, achieving certain use patterns (e.g., sufficient nicotine administration to forestall strong cravings after initially transitioning from smoking, or administering a new minimum amount of nicotine in accordance with a planned taper to nicotine cessation) can result in a virtual credit or actual monetary reward that can reinforce the user's pattern of nicotine administration. Customized feedback can also be used to leverage psychological principles important in smoking cessation. For example, a user could be given feedback that his/her pattern of use is consistent with his/her goals (e.g., quitting smoking) or aim to enhance his/her self-efficacy by demonstrating that the user is becoming less dependent on nicotine based on a real world nicotine challenge presented by ENDS device described herein (e.g., by administering a test dose containing no nicotine or less nicotine than the user had been administering and demonstrating that their nicotine craving did not increase, or significantly increase, after that challenge dose). In some embodiments, the ENDS delivery device or web backend system can reinforce a user's self-efficacy by giving him/her feedback that his/her pattern of use is indicative of other users who successfully abstain from smoking. In some cases, an ENDS device or web backend system can give the user feedback that his/her mean nicotine dose is decreasing over time, despite it initially remaining constant or nearly constant, so as to enhance self-efficacy and increase his/her resilience in the face of environmental smoking cues that could otherwise trigger a smoking lapse or relapse.

An "active agent" refers to any material that is capable of being aerosolized and inhaled by a user. Such active agents may be incorporated into a vaporizer to be assessed by the system and method described herein. For example, many active agents may be contemplated for use with the vaporizer to be identified and assessed by the present invention include, but are not limited to, those containing tobacco, natural or artificial flavorants, coffee grounds or coffee beans, mint, chamomile, lemon, honey, tea leaves, cocoa, and other non-tobacco alternatives based on other botanicals. The vaporizer can also be compatible for use with pharmaceutical compounds or synthetic compounds, either for pharmaceutical or pleasurable use. Any such compound which can be vaporized (or volatized) at a relatively low temperature and without harmful degradation products can be suitable for use with the device. Examples of compounds include, but are not limited to, menthol, caffeine, taurine, and nicotine.

Any of the methods (including user interfaces) described herein may be implemented as software, hardware or firmware, and may be described as a non-transitory computer-readable storage medium storing a set of instructions capable of being executed by a processor (e.g., computer, tablet, smartphone, etc.), that when executed by the processor causes the processor to control perform any of the steps, including but not limited to: displaying, communicating with the user, analyzing, modifying parameters (including timing, frequency, intensity, etc.), determining, alerting, or the like.

Example 1

A model to predict nicotine emission by the nicotine delivery device based on its design and operating conditions is described herein. Such a model may be used as a tool to predict emission or consumption of existing and future nicotine delivery products. The model formulation and experimental investigation is described in an article titled "Transport phenomena governing nicotine emissions from electronic cigarettes: model formulation and experimental investigation" by Talih, S. et. al.

A single control volume (CV) model is formulated to compute the vaporization rate of individual species from the coil-wick assembly. Vapors are emitted by evaporation or boiling from the surface of the CV, and fresh liquid enters through the wick boundaries. The material, thermal, electrical, and enthalpy fluxes through the CV are computed in discrete time steps to determine its instantaneous temperature and composition, which are assumed uniform everywhere. The temperature outside the CV is assumed to be that of the surroundings, Too, and the liquid composition outside the CV is assumed to be constant and equal to that of the parent liquid. During puffing, fresh liquid is assumed to enter the cylinder at a rate equal to the instantaneous liquid vaporization rate, mv, such that the total CV mass remains constant. Fresh liquid is assumed to mix instantaneously with the contents of the CV, and the composition of the liquid in the CV is computed by species conservation. Between puffs, it is assumed that species diffusion is rapid, and that by the start of the next puff the liquid composition in the CV matches that of the parent liquid in the reservoir.

The principle of energy conservation is employed to compute the instantaneous temperature of the CV. They include the conversion of input electrical energy into thermal energy, the heat loss to the air flowing over the cylinder, the heating and vaporization of liquid flowing through the CV, heat dissipated by conduction to the surroundings, and the heating up of the CV itself. The instantaneous temperature of the cylinder, T (K), is found by numerical integration of the unsteady energy equation:

$$C\frac{dT}{dt} = \dot{E}_e - (\dot{Q}_{conv} + \dot{Q}_{cond} + \dot{Q}_{lat} + \dot{Q}_{liq})$$

where Ė e is the electrical power input to the device (W); Qconv=hA (T−T∞) is the rate of heat transfer by convection to the air flowing over the cylinder (W), where h is the heat transfer coefficient of a cylinder in cross flow (W m-2 K-1), A is the surface area of the cylinder (m2), and T∞_is the ambient air temperature; Qcond=K (T−T∞) is the rate of heat transfer by conduction through the wick and electrical leads, where K is the lumped thermal resistance to the surroundings (W K−1); Qlat=ṁvhfg,liq is the latent heat associated with change of phase from liquid to vapor, where mv is the liquid vaporization rate (kg s-1), and the latent heat of vaporization, hfg,liq, is taken as the mass-weighted average of the latent heats of the liquid constituents (J kg-1); Qliq=ṁvcp,liq (T−T∞) is the energy expended heating the liquid entering the CV, where cp, liq is the specific heat of the liquid (J kg-1 K-1); C is the effective heat capacity of the liquid-wick system given by C=f (Vwickρwickcp,wick+Vliqρliqcp,liq (kJ K-1), where V is the volume (m3), and ρ_is the density (kg m-3). f is an empirical constant used to account for the non-uniform heating of the wick and liquid in the vicinity of the heating coil, and is derived by minimizing error between predictions and observations (see Supplemental Information (S1)) for methodology and sensitivity analyses).

The boiling temperature of the liquid, Tb (K), is evaluated based on the instantaneous composition ignoring trace constituents, assuming ideal solution behavior. See Supplemental Information (S2) for empirical validation of the ideal solution assumption for PG-VG mixtures.

When the CV temperature is below boiling, ṁi, the vaporization rate of species i, is computed assuming evaporative partitioning governed by convective mass transfer:

$$\dot{m}_i = h_{m,i}A\frac{M_i}{Ru}\frac{P_i}{T}$$

where $$P_i = x_i P_i^*$$

is the partial pressure of the evaporating species (Pa), xi is the mole fraction of i in the liquid, and is the vapor pressure of the evaporating species computed at T. M is the molar mass of the evaporating species (kg mol-1), Ru is the universal gas constant (J mol-1 K-1), hm is the mass transfer coefficient (m2 s-1) and is calculated according the Churchill and Bernstein correlation (Churchill and Bernstein 1977) for cross flow over a cylinder. The total vaporization rate, mv is then calculated as ṁv=Σṁi. If the cylinder temperature reaches the computed Tb, the system is switched to a boiling regime in which the temperature of the cylinder is forced to Tb, and the liquid vaporization rate is then computed by balancing the resulting energy flows using Equation 1.

In either vaporization or boiling regimes, the nicotine mass flux is computed as the product of the nicotine mass fraction in the liquid and the total liquid vaporization rate. The mass fractions of solvent species (PG, VG, water) in the vapors are computed based on the mole fraction and vapor pressure of each species, in accordance with Raoult's Law. The instantaneous composition of the liquid remaining in the cylinder is computed using a species mass balance given by:

$$\frac{dm_i}{dt} = m_{liq}\frac{dw_i}{dt} = w_{i,p}\dot{m}_v - \dot{m}_i$$

where mi and wi are the mass and mass fraction of species i in the cylinder, mliq=Vliqρliq is the mass of liquid in the cylinder (kg), and wi,p is the mass fraction of species i in the parent liquid. It should be noted that the fluxes computed using Equation 4 represent the potential emissions from the device. In reality, some portion of the vaporized material will re-condense on the inner surfaces of the ECIG device, depending on the flow geometry and operating conditions. Thus for clarity, computed fluxes are referred to below as "potential emissions" or "potential yield". "Yield" refers to the integrated flux (i.e., the total mass) emitted over a given number of puffs.

In summary, the model provides a time-resolved description of the vaporization processes during ECIG operation, accounting for the changing temperature and composition of the liquid in the heated zone resulting from the intermittent powering of the heating coil and the airflow drawn over it. The model utilizes one empirical constant, f, to account for the non-uniform heating of the wick. f is optimized to provide the best correlation between computed potential and measured nicotine yields over a range of liquid compositions, powers, and puff parameters, as described.

A simplified steady-state model of nicotine flux can be derived by assuming that the cylinder instantaneously attains the liquid boiling temperature when the coil is energized, that the vapor composition is equal to the parent liquid composition and is constant in time, and that heat losses from the cylinder to the surroundings can be neglected. Under these conditions, the vaporization rate during a puff may be computed directly as, where ṁi=wi,pṁv $$\dot{m}_v = \sum \dot{m}_i = \frac{\dot{E}_e}{h_{fg,liq}}$$

It is to be understood that this invention is not limited to any particular embodiment described herein and may vary. It is also to be understood that the terminology used herein is for the purpose of describing particular embodiments only, and is not intended to be limiting, since the scope of the present invention will be limited only by the appended claims.

Where a range of values is provided, it is understood that each intervening value between the upper and lower limit of that range (to a tenth of the unit of the lower limit) is included in the range and encompassed within the invention, unless the context or description clearly dictates otherwise.

In addition, smaller ranges between any two values in the range are encompassed, unless the context or description clearly indicates otherwise.

Unless defined otherwise, all technical and scientific terms used herein have the same meaning as commonly understood by one of ordinary skill in the art to which this invention belongs. Representative illustrative methods and materials are herein described; methods and materials similar or equivalent to those described herein can also be used in the practice or testing of the present invention.

All publications and patents cited in this specification are herein incorporated by reference as if each individual publication or patent were specifically and individually indicated to be incorporated by reference, and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual dates of public availability and may need to be independently confirmed.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as support for the recitation in the claims of such exclusive terminology as "solely," "only" and the like in connection with the recitation of claim elements, or use of a "negative" limitations, such as "wherein [a particular feature or element] is absent", or "except for [a particular feature or element]", or "wherein [a particular feature or element] is not present (included, etc.) . . . ". Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

What is claimed is:

1. A computer-implemented method of determining an amount of delivered active agent emitted from a plurality of different electronic vaporizers to a subject over a period of time, comprising:

obtaining a plurality of images with a camera on a mobile device of each of the plurality of different the electronic vaporizers the subject consumes over the period of time, wherein the plurality of images capture information for identifying a type of electronic vaporizer being used by the subject, and wherein sequential images of the plurality of images associated with any single electronic vaporizer of the plurality of different electronic vaporizers used by the subject during the period of time are useable to determine a depletion in volume from the single electronic vaporizer;

transmitting the plurality of images to a server or system of servers, wherein the server or system of servers comprises a memory having an image database comprising i) a plurality of images associated with a plurality of different electronic vaporizers, and ii) device information associated with each of the plurality of different electronic vaporizers;

at the server or system of servers, identifying a match between each single electronic vaporizer of the plurality of different electronic vaporizers used by the subject during the period of time and at least one image of the plurality of the images in the image database of the plurality of different electronic vaporizers, wherein the identifying step produces an identified electronic vaporizer;

at the server or system of servers, and for each of the plurality of different electronic vaporizers, detecting the depletion in volume from the sequential images of the plurality of images associated with the identified electronic vaporizer for each of a plurality of sets of sequential images for the identified electronic vaporizer for the period of time, and calculating a volume of fluid consumed from each of the plurality of sets of sequential images for the identified electronic vaporizer for the period of time; and using, at the server or system of servers, at least a portion of the device information for the identified electronic vaporizer and the volume of fluid consumed from each of the plurality of sets of sequential images for the period of time to compute an amount of active agent emitted to the subject over the period of time from all of the plurality of different electronic vaporizers.

2. The method of claim 1, wherein the device information is selected from the group consisting of type of vaporizer, voltage, heater resistance, power, type of liquid, maximum refillable amount of liquid, maximum concentration of liquid, and combinations thereof.

3. The method of claim 1, wherein each electronic vaporizer is an electronic nicotine delivery system (ENDS) device.

4. The method of claim 1, further comprising using the mobile device to provide the server or system of servers with one or more inputs selected from the group consisting of a text message, a voice recording, a video, a user interface, a data file and combinations thereof.

5. The method of claim 1 wherein the period of time is measured in days, weeks, months, or years.

6. A non-transitory computer readable medium comprising computer executable instructions embodied in the computer readable medium that when executed by a processor of a computer control the computer to perform steps comprising:

obtaining a plurality of images with receiving one or more inputs including at least one image of each electronic vaporizer from a camera on a mobile device of a plurality of different electronic vaporizers a subject consumes over a period of time, wherein the plurality of images capture information for identifying a type of electronic vaporizer being used by the subject, and wherein sequential images of the plurality of images associated with any single electronic vaporizer of the plurality of different electronic vaporizers used by the subject during the period of time are useable to determine a depletion in volume from the single electronic vaporizer;

transmitting the plurality of images to a server or system of servers, wherein the server or system of servers comprises a memory having an image database comprising i) a plurality of images associated with a plurality of different electronic vaporizers and ii) device information associated with each of the plurality of different electronic vaporizers;

at the server or system of servers, identifying a match between each single electronic vaporizer of the plurality of different electronic vaporizers used by the subject during the period of time and at least one image of the plurality of the images in the image database of the plurality of different electronic vaporizers, wherein the identifying step produces an identified electronic vaporizer;

at the server or system of servers, and for each of the plurality of different electronic vaporizers, detecting the depletion in volume from the sequential images of the plurality of images associated with the identified electronic vaporizer for each of a plurality of sets of sequential images for the identified electronic vaporizer for the period of time, and calculating a volume of fluid consumed from each of the plurality of sets of sequential images for the identified electronic vaporizer for the period of time; and using, at the server or system of servers, at least a portion of the device information for the identified electronic vaporizer and the volume of fluid consumed from each of the plurality of sets of sequential images for the period of time to compute an amount of active agent emitted to the subject over the period of time from all of the plurality of different electronic vaporizers.

7. The non-transitory computer readable medium of claim 6, wherein the device information is selected from the group consisting of type of device, voltage, heater resistance, power, type of nicotine, maximum refillable amount of liquid nicotine, maximum concentration of liquid nicotine, and combinations thereof.

8. The non-transitory computer readable medium of claim 6, wherein each electronic vaporizer is an electronic nicotine delivery system (ENDS) device.

9. The non-transitory computer readable medium of claim 6, wherein the computer executable instructions further comprise instructions for using the mobile device to provide the server or system of servers with one or more inputs selected from the consisting of a text message, a voice recording, a video, a user interface, a data file and combinations thereof.

10. The non-transitory computer readable medium of claim 6 wherein the period of time is measured in days, weeks, months, or years.

11. A system for determining an amount of delivered active agent emitted from a plurality of different electronic vaporizers to a subject over a period of time, comprising:

a remote server or system of remote servers in communication with a mobile device configured to obtain a plurality of images with a camera on the mobile device of each of the plurality of electronic vaporizers the subject consumes over the period of time, wherein the plurality of images capture information for identifying a type of electronic vaporizer being used by the subject, and wherein sequential images of the plurality of images associated with any single electronic vaporizer of the one or more electronic vaporizers used by the subject during the period of time are useable to determine a depletion in volume from the single electronic vaporizer;

wherein the remote server or system of remote servers is operatively coupled to one or more processors and a memory having an image database comprising i) a plurality of images associated with a plurality of different electronic vaporizers, and ii) device information associated with each of the plurality of different electronic vaporizers, wherein the remote server or system of remote servers is configured to:

receive the plurality of images of each of the plurality of different electronic vaporizers the subject consumes over the period of time;

identify a match between each single electronic vaporizer of the one or more electronic vaporizers used by the subject during the period of time and at least one image of the plurality of images in the image database of the plurality of different electronic vaporizers to produce an identified electronic vaporizer;

for each of the plurality of different electronic vaporizers, detect the depletion in volume from the sequential images of the plurality of images associated with the identified electronic vaporizer for each of a plurality of sets of sequential images for the identified electronic vaporizer for the period of time, and calculate a volume of fluid consumed from each of the plurality of sets of sequential images for the identified electronic vaporizer for the period of time; and use at least a portion of the device information for the identified electronic vaporizer and the volume of fluid consumed from each of the plurality of sets of sequential images for the period of time to compute an amount of active agent emitted to the subject over the period of time from all of the plurality of different electronic vaporizers.

12. The system of claim 11, wherein the device information is selected from the group consisting of type of vaporizer, voltage, heater resistance, power, type of liquid, maximum refillable amount of liquid, maximum concentration of liquid, and combinations thereof.

13. The system of claim 11, wherein each electronic vaporizer is an electronic nicotine delivery system (ENDS) device.

14. The system of claim 13, wherein the remote server or system of remote servers is further configured to analyze the volume of nicotine consumed by the user over a fixed time period for determining an estimate of nicotine consumption metric.

15. The system of claim 11, wherein the remote server or system of remote servers is further configured to receive one or more inputs from a user of the mobile device describing the electronic vaporizer.

16. The system of claim 15, wherein the one or more inputs are a text message, a voice recording, a video, a user interface, a data file or any combination thereof.

17. The system of claim 11, wherein the remote server or system of remote servers is further configured to transmit the at least a portion of the device information to the mobile device via a user interface, a text message, a social networking message, a phone call, an automated voice message, a display, or any combination thereof.

18. The system of claim 11 wherein the period of time is measured in days, weeks, months, or years.

* * * * *